US005224848A

United States Patent [19]

Noburu et al.

[11] Patent Number: 5,224,848

[45] Date of Patent: Jul. 6, 1993

[54] SCROLL COMPRESSOR WITH DISCHARGE VALVE OPENED BY CENTRIFUGAL FORCE

[75] Inventors: Yoshinori Noburu; Toshihiko Mitsunaga; Kazuyoshi Sugimoto, all of Oizumi, Japan

[73] Assignee: Sanyo Electric Co., Ltd., Osaka, Japan

[21] Appl. No.: 778,059

[22] PCT Filed: Apr. 19, 1991

[86] PCT No.: PCT/JP91/00520

§ 371 Date: Dec. 3, 1991

§ 102(e) Date: Dec. 3, 1991

[87] PCT Pub. No.: WO91/17360

PCT Pub. Date: Nov. 14, 1991

[30] Foreign Application Priority Data

Apr. 27, 1990 [JP] Japan ..... 2-113136

Jul. 16, 1990 [JP] Japan ..... 2-188752

[51] Int. Cl.[5] ..... F04C 18/04; F04C 29/08

[52] U.S. Cl. ..... 418/55.1; 418/187; 418/188; 418/270

[58] Field of Search ..... 418/55.1, 55.3, 188, 418/270, 187

[56] References Cited

U.S. PATENT DOCUMENTS

| | | | |
|---|---|---|---|
| 4,781,550 | 11/1988 | Morishita et al. | 418/188 |
| 4,842,499 | 6/1989 | Nishida et al. | 418/188 |
| 4,846,640 | 7/1989 | Nishida et al. | 418/188 |
| 4,865,530 | 9/1989 | Nishida et al. | 418/188 |

FOREIGN PATENT DOCUMENTS

| | | |
|---|---|---|
| 0069531 | 1/1983 | European Pat. Off. . |
| 58-2490 | 1/1983 | Japan . |
| 60-108585 | 6/1985 | Japan . |
| 61-26639 | 8/1986 | Japan . |
| 63-80089 | 4/1988 | Japan . |
| 1-35196 | 7/1989 | Japan . |

*Primary Examiner*—John J. Vrablik

*Attorney, Agent, or Firm*—Wenderoth, Lind & Ponack

[57] ABSTRACT

A scroll compressor having a first scroll member and a second scroll member includes a discharge valve device for closing an opening of a discharge port in which the discharge opening is disposed in at least one of the first and second scroll members. The discharge valve device is configured so that it is effected by a centrifugal force during operation of the scroll compressor. The centrifugal force normally maintains the discharge valve device in an open position with respect to the discharge opening. Thus, the discharge valve device is not actuated by a pressure difference between the discharge opening and the high pressure chamber and the scroll members are not rotated in reverse when operation of the scroll compressor is stopped.

9 Claims, 4 Drawing Sheets

SCROLL COMPRESSOR WITH DISCHARGE VALVE OPENED BY CENTRIFUGAL FORCE

TECHNICAL FIELD

The present invention relates to a scroll compressor having a driving scroll member and a driven (idling) scroll member directly rotated by the driving scroll member, wherein the two scroll members are rotated in the same direction.

BACKGROUND OF THE INVENTION

A conventional scroll compressor is shown in, for example, Japanese Patent Publication No. 1-35196/1989 (examined) in which the first and second scroll members are in an eccentric relation with each other and are rotated in the same direction to compress a refrigerant in the compression space to thereby reduce vibration during compression, so that the scroll compressor can be used for high-speed and/or large-scale applications.

However, in the conventional scroll compressor, the refrigerant in a central compression space is discharged directly to a discharge chamber from a discharge port of a rotary shaft and, accordingly, it is difficult to affix a check valve directly to the rotary shaft. Besides, when the compressor is stopped, it is likely that the refrigerant in the discharge chamber will flow back into the compression space through the discharge port to cause reverse rotation of the first and second scrolls.

SUMMARY OF THE INVENTION

An object of the present invention is to provide an improved scroll compressor which permits the discharge port to normally remain open during operation and to close when the operation of the scroll compressor is stopped and, wherein the discharge port is disposed in at least one of a first scroll member and a second scroll member.

According to the present invention, there is provided a scroll compressor incorporating an electric motor unit and a scroll compressor unit in a sealed container, wherein the scroll compressor unit has:

a first scroll member having an end plate, a wrap shaped as an involute curve projecting from one side of the end plate, and a rotary shaft projecting from the other side of the end plate and connected to the electric motor unit;

a second scroll member having an end plate, a wrap shaped as an involute curve projecting from one side of the end plate, and a rotary shaft projecting from the other side of the end plate of the second scroll member;

a main frame rotatably supporting the shaft of the first scroll member;

a subsidiary frame rotatably supporting the shaft of the second scroll member;

the wrap of the first scroll member being in a juxtaposed engagement relation with the wrap of the second scroll member, and the shaft of the second scroll member being eccentrically spaced from the shaft of the first scroll member so that the wraps of the two scroll members are fitted closely together to form a plurality of compression spaces; and a driving device for rotating the second scroll member in the same direction as the first scroll member to continuously compress the compression spaces radially inwardly from an outer position to an inner position;

wherein at least one of the first and second scroll members has a discharge port connected to the compression space, an opening to allow flow of a refrigerant, discharged into the discharge port, into the sealed container, and a check valve for closing the opening of the discharge port.

By the construction described above, the check valve is disposed at the opening of the discharge port of the first or second scroll member in such a manner that the check valve is so configured that it is effected by a centrifugal force during rotation of the shaft of the scroll member, such that the check valve is normally maintained open by the centrifugal force. Thus, the check valve is prevented from being actuated by a pressure difference between the discharge port and a high pressure chamber in the sealed container, such that reverse rotation of the scroll members can be prevented.

In another embodiment of the present invention, at least one of the first and second scroll members is provided with, at its rotary shaft, a discharge port connected to the compression space, and an opening connected to the discharge port is disposed on an outer surface of the rotary shaft. Further, the rotary shaft is provided with an arc-shaped spring-like discharge valve for closing the opening and a holding means for holding the discharge valve in such a manner that the holding means is disposed at an outer position of the discharge valve.

In the embodiment described, the discharge valve for closing the discharge port has a spring-like arc-shaped structure such that it is effected by a centrifugal force, so that the discharge valve is normally maintained open by the centrifugal force. Thus, the discharge valve is not accidentally activated by a pressure difference between the discharge port and the high pressure chamber of the compressor unit and, at the same time, reverse rotation of the scroll members when operation of the scroll member is stopped can be prevented.

PREFERRED EMBODIMENTS OF THE INVENTION

Figure 1:
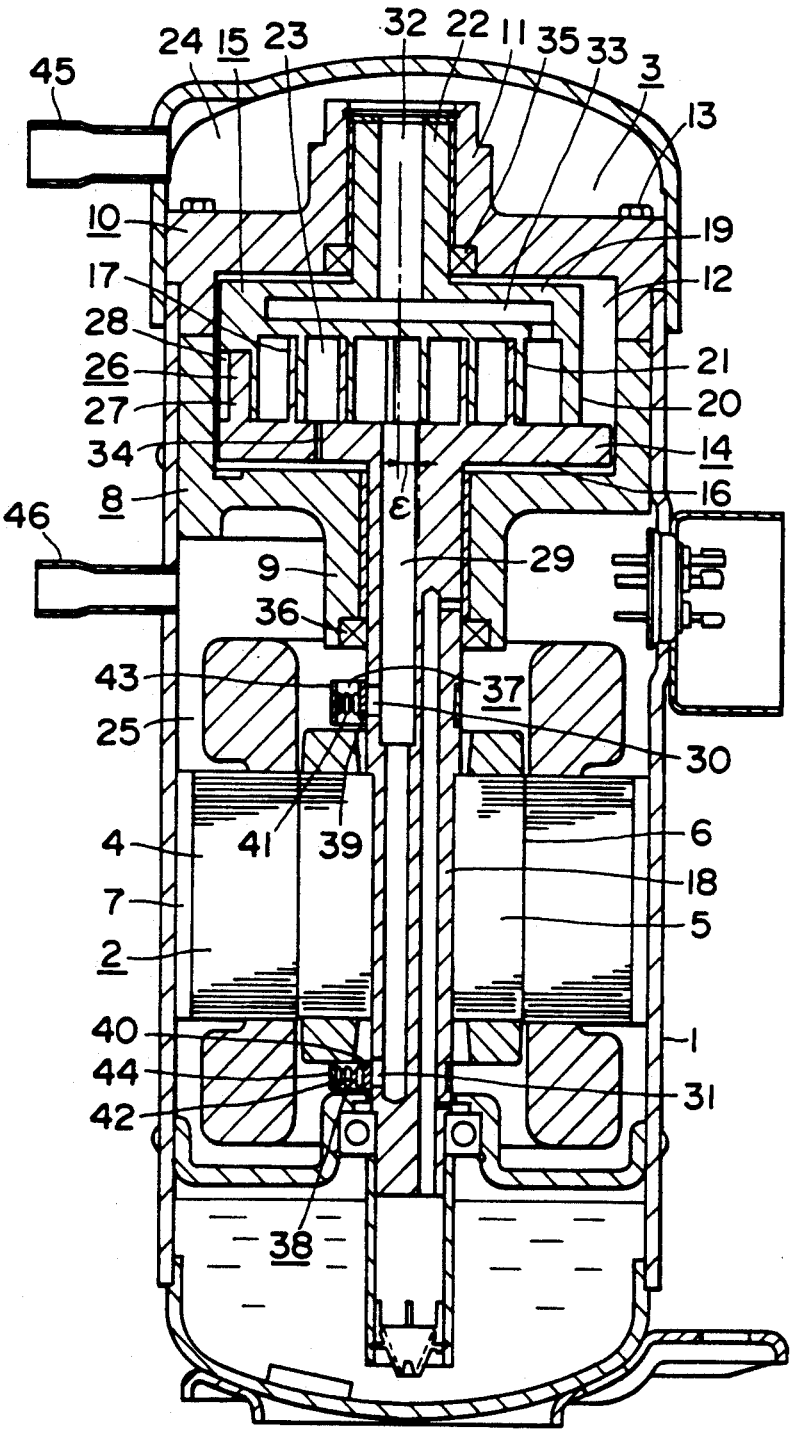
FIG. 1 is a sectional elevation view of a scroll compressor embodying the present invention.

A first preferred embodiment of the present invention will be described with reference to FIGS. 1 and 2.

An electric motor unit 2 and a scroll compressor unit 3 are disposed in a lower portion and an upper portion, respectively, of a sealed container 1. The electric motor unit 2 has a stator 4 and a rotor 5 inside the stator with an air gap 6 therebetween. A passage 7 is formed in the outer surface of the stator 4 by partly cutting out the outer surface of the stator. A main frame 8 is press-fitted to an inner surface of the sealed container 1 and is provided with a main bearing 9 at a center thereof and, similarly, a subsidiary frame 10 is press-fitted to the inner surface of the sealed container 1. The subsidiary frame 10 has a subsidiary bearing 11 at a center thereof but spaced from the main bearing 9 of the main frame 8 by a distance "$\epsilon$", and the main frame 8 and the subsidiary frame 10 are connected together by bolts 13 to form a chamber 12.

The scroll compressor unit 3 has a first scroll 14 (i.e., driving scroll) and a second scroll 15 (i.e., idler or driven scroll) rotated in the same direction as the driving scroll 14. The driving scroll 14 has a disc end plate 16, a spiral wrap 17 extending from an upper surface of the end plate 16 in an involute curve configuration, and a driving shaft 18 projecting from a center of the lower surface of the end plate 16 to be fitted fixedly into a bore of the rotor 5. The driven scroll 15 has a disc end plate 19, an annular wall 20 projecting from an outer circumference of the end plate 19 to slidably contact the end plate 16 of the driving scroll 14, a spiral wrap 21 extending from a lower surface of the end plate 19 in an angle-corrected involute curve configuration inside the annular wall 20, and an idler shaft 22.

The spiral wrap 17 of the driving scroll 14 has coordinates which are obtained by:

$$X=R\ (\cos\theta+\theta\sin\theta)$$

$$Y=R\ (\sin\theta-\theta\cos\theta)$$

and the spiral wrap 21 in an angle-corrected involute curve of the driven scroll 15 has coordinates which are obtained by:

$$X=-R\ [\cos\theta+(\theta+\beta)\sin(\theta+\beta)]$$

$$Y=-R\ [\sin\theta-(\theta+\beta)\cos(\theta+\beta)]$$

$$\beta=\tan^{-1}\{P\sin\theta\ /\ (P\cos\theta+\epsilon)\}$$

wherein:

R: a radius of a basic circle

P: a radius of a circular orbit of a driving pin

The driving shaft 18 of the driving scroll 14 is journalled on the main bearing 9 of the main frame 8, and the idler shaft 22 of the driven scroll 15 is journalled on the subsidiary bearing 11. The driving scroll 14 and the driven scroll 15 are placed in a confronting engagement relationship in the chamber 12 so that the wraps 17, 21 of the two scrolls 14, 15 are contacted with each other at a plurality of points to form a plurality of compression spaces 23.

The interior of the sealed container 1 is divided into a low pressure chamber 24 and a high pressure chamber 25 by the main frame 8 and the subsidiary frame 10.

A driving device 26 has a driving pin 27 projecting from an outer circumference of the end plate 16 of the driving scroll 14, and a guide groove 28 extending in a radial direction on the annular wall 20 of the driven scroll 15 for receiving therein the driving pin 27. The guide groove 28 is formed in a U-shape by cutting an outer portion of the driven scroll 15 so that a circular orbit of the outer circumferential end of the guide groove 28 is positioned outside a circular orbit of the center of the driving pin 27.

The driving shaft 18 has a discharge port 29 for discharging therethrough a compressed refrigerant from the compression space 23 into the high pressure chamber 25. The discharge port 29 has an upper opening 30 and a lower opening 31, both of the openings 30, 31 being connected to the high pressure chamber 25.

The idler shaft 22 has a suction port 32 for directing the refrigerant from the low pressure chamber 24 to the compression space 23. The end plate 19 has a channel 33 which is connected to the suction port 32 for directing the refrigerant inwardly into the compression space 23.

The end plate 16 of the first scroll 14 has a small through-hole 34 which connects the compression space 23 at a mid-compression point with the chamber 12. The chamber 12 and the low pressure chamber 24 are hermetically sealed and shielded with each other by the sealing member 35 disposed on a sliding surface of the subsidiary bearing 11 of the subsidiary frame 10 relative to the idler shaft 22 of the driven scroll 15. Similarly, the chamber 12 and the high pressure chamber 25 are hermetically sealed by a sealing member 36 disposed on a sliding surface of the main bearing of the main frame 8 relative to the driving shaft 18 of the driving scroll 14. The structure which has been described so far in connection with the first embodiment is common to the other embodiments shown in FIGS. 3–8.

Referring again to FIGS. 1 and 2, a check valve 37 has a valve body 39 for closing and opening a discharge opening 30, a spring 41 for biasing the check valve 37 toward the driving shaft 18, and a holder 43 fitted to the driving shaft 18 for fixing one end of the spring 41. Similarly, a check valve 38 has a valve body 40 for closing and opening a discharge opening 31, a spring 42 for biasing the check valve 38 toward the driving shaft 18, and a holder 44 fitted to the driving shaft 18 for fixing one end of the spring 42. The valve bodies 39, 40 are made of materials having a large mass.

A suction pipe 45 is disposed at an upper portion of the sealed container 1 so that it is connected with the low pressure chamber 24, and a discharge pipe 46 is disposed adjacent the lower portion of the main frame 8 so that it is connected with the high pressure chamber 25.

Figure 2:
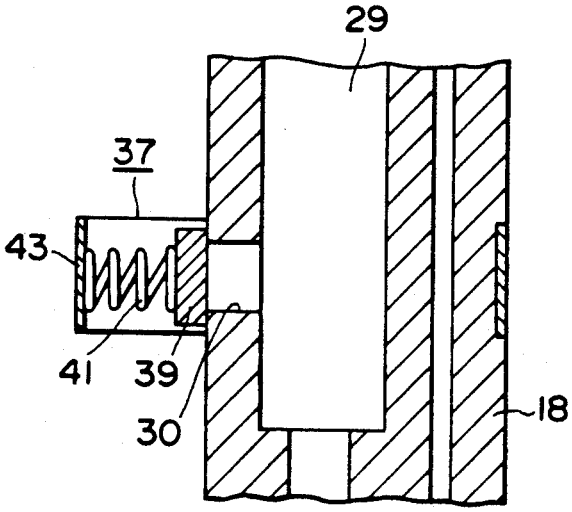
FIG. 2 is an enlarged sectional view of a part of a check valve employed in the scroll compressor shown in FIG. 1.

In the scroll compressor shown in FIGS. 1 and 2, when the electric motor unit 2 is driven, the first or driving scroll 14 is rotated through the main driving shaft 18 and then a rotational force of the driving scroll 14 is delivered to the second or driven scroll 15 through the driving device 26. Thus, the driven scroll 15 is rotated in the same direction as the driving scroll 14. The idler shaft 22 of the driven scroll 15 is eccentrically spaced from the driving shaft 18 of the driving scroll 14 by a distance "$\epsilon$" and accordingly the driven scroll 15 is eccentrically rotated relative to the driving scroll 14. Thus, the compression space 23 is gradually reduced in volume from an outer position toward an inner position of the spiral wraps, and the refrigerant which flows from the suction pipe 45 into the low pressure chamber 24 is directed into the compression space 23 through the suction port 32 of the shaft 22 and the channel 33 of the end plate 19 to be compressed. The thus compressed refrigerant is fed to the discharge port 29 of the main driving shaft 18 of the driving scroll 14 and then to the high pressure chamber 25 through the discharge openings 30, 31, and after that is discharged out of the sealed container 1 through the discharge pipe 46. If the refrigerant is in a mid-compression stage and is at a middle pressure, it is discharged into the chamber 12 form the small through-hole 34 so that it serves as a back pressure against the two scrolls 14, 15, and the ends of the two spiral wraps 17, 21 of the driving and driven scroll members 14, 15 are slidably moved along the surfaces of the end plates 16, 19 with a constant clearance maintained between the two ends of the wraps.

As described, the second or driven scroll 15 is rotated in the same direction as the first or driving scroll 14 by means of the driving devices 26, and the driving device 26 is constructed in such a manner that a circular orbit of the outer circumference of the guide groove 28 is located outside a circular orbit of a center of the driving pin 27. By this construction, the driving pin 27 is snugly and reliably received in the guide groove 28 without removal therefrom, and only a single driving pin 27 can rotate the two scrolls in the same direction to gradually reduce the volume of the compression space 23 to provide the predetermined compression. Further, the center of the driving scroll 14 is deviated or spaced from the center of the driven scroll 15 by a distance "$\epsilon$" and the spiral wrap 17 of the driving scroll 14 is formed in an involute curve configuration whereas the spiral wrap 21 of the driven scroll 15 is formed in an angle-corrected involute curve configuration. This construction permits a suitable contact between the two wraps 17, 21 and prevents one wrap from releasing from, and abnormally press-fitting against, the other wrap so that a preferable compression is attained by the compression space 23, even when the rotational speed of the scroll members is changed.

Since the low pressure chamber 24 and the high pressure chamber 25 are hermetically sealed by the sealing members 35, 36, a refrigerant of low pressure or high pressure is prohibited from flowing into the chamber 12 within the main and subsidiary frames 8 and 10 so that the predetermined middle pressure can be maintained in the chamber 12. Thus, a suitable sealing force in the axial direction of the two scrolls 14, 15 can be maintained.

The compressed refrigerant in the compression space 23 is discharged from the upper opening 30 and the lower opening 31 into the high pressure chamber 25 through the discharge port 29 and, therefore, pressure reduction of the refrigerant discharged into the high pressure chamber 25 can be prevented. In addition, the refrigerant from the lower discharge opening 31 is directed to the discharge pipe 46 through the air gap 6 and the passage 7 of the electric motor unit 2 and efficiently cools the electric motor unit 2 and, at the same time, the heat of the electric motor unit 2 is effectively utilized.

In each of the check valves 37, 38, rotation of the main driving shaft 18 results in a centrifugal force acting on the massive bodies 39, 40 and the discharge openings 30, 31 are normally forced open against a resilient biasing force of the springs 41, 42, so that they do not serve as a resistance to the refrigerant flowing from the compression space 23 to the high pressure chamber 25 through the discharge port 29. Thus, when a high compression ratio is present in a refrigeration operation in which less refrigerant is flowing from the compression space 23 into the discharge port 29, the check valves 37, 38 are not actuated by a pressure difference between the discharge port 29 and the high pressure chamber 25. In addition, the valve bodies 39, 40 of the check valves 37, 38, respectively, are pressed toward the main driving shaft 18 by the resilient force of the springs 41, 42 when the operation stops and, accordingly, the discharge openings 30, 31 are closed to cut off the communication between the high pressure chamber 25 and the compression space 23. Thus, the refrigerant in the high pressure chamber 25 is prevented from flowing back into the compression space 23.

In the embodiment described above, the check valves 37, 38 are fitted to the main driving shaft 18. However, if desired, the check valves can be fitted to the subsidiary shaft by providing suitable discharge openings thereto.

According to the first embodiment of the invention explained with reference to FIGS. 1 and 2, check valves are provided to either the driving shaft of the first scroll member or the shaft of the second scroll member to selectively open and close the openings of the discharge port, and the check valves are so formed that they are effected by a centrifugal force due to rotation of the shaft. Therefore, when the scroll compressor is driven, the check valves are effected by a centrifugal force to thereby normally open the openings of the discharge port so that an increase in resistance at the passage or channel thereof can be prevented and, in addition, noise due to the valve actuation can be reduced substantially under high compression ratio operation since the valves are normally opened. Further, the openings of the discharge port are closed when the operation is stopped and accordingly the refrigerant in the high pressure chamber is prevented from flowing back into the compression space.

Figure 4:
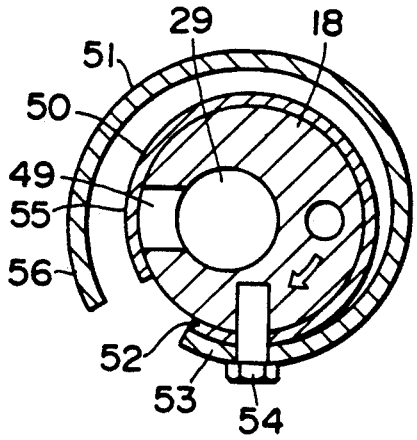
FIG. 4 is an enlarged sectional view of a part of a check valve employed in the scroll compressor shown in FIG. 3.
Figure 3:
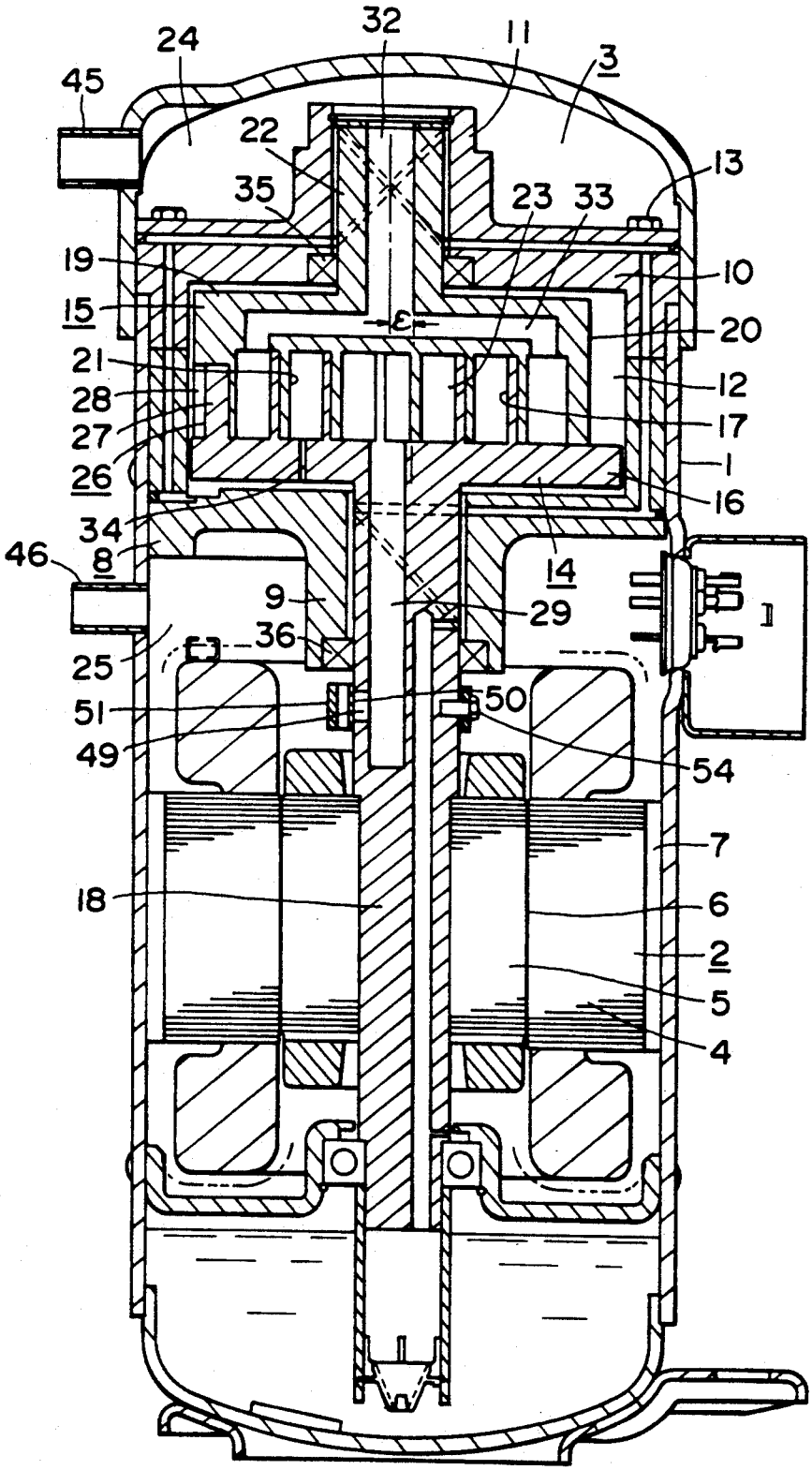
FIG. 3 is a sectional elevation view of a scroll compressor according to another embodiment of the invention.

FIGS. 3 and 4 show a second embodiment of the present invention. In FIGS. 3 and 4, like reference numerals represent like parts with respect to the previous embodiment of FIGS. 1 and 2, and the general structure as similar to that of the previous embodiment. Accordingly, an explanation of the same or similar structural features will be omitted for simplification purposes only.

In the embodiment of FIGS. 3 and 4, the suction pipe 45 is connected to the low pressure chamber 24 and the discharge pipe 46 is connected to the high pressure chamber 25. A discharge opening 49, similar to the discharge opening 30 in the FIG. 1 embodiment, is provided on the driving shaft 18, and a circular or arc-shaped spring valve 50 is provided to close the discharge opening 49. The spring valve 50 is held to the driving shaft 18 by a circular or arc-shaped valve holder 51.

As shown in FIG. 4, the discharge valve 50 and its valve holder 51 are commonly fixed at first respective ends 52, 53 thereof to the driving shaft 18 by means of a screw 54. The second respective ends 55, 56 of the valve 50 and valve holder 51 are located outside the discharge opening 49. The first ends 52, 53 of the discharge valve 50 and its holder 51 precede the second ends 55, 56 during rotation of the driving shaft 18 in a rotational direction shown by an arrow in FIG. 4, and the discharge valve 50 is resiliently pressed against the outer surface of the driving shaft 18.

In the structure described above, the discharge valve 50 is press-fitted around the driving shaft 18 by its spring force to close the discharge opening 49 when the operation is stopped. Accordingly, this prevents backflow of the refrigerant and also prevents reverse rotation of the scroll compression unit 3 and a resultant generation of noise and damage. In operation of the scroll compressor, the driving shaft 18 is rotated to permit the discharge valve 50 to be opened by a centrifugal force, so that the compressed refrigerant is readily discharged out of the discharge opening 49 without obstruction.

Figure 5:
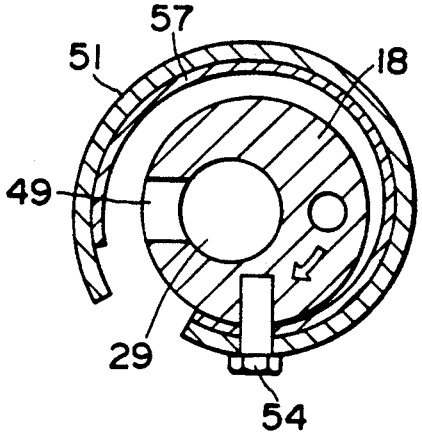
FIG. 5 is a sectional view showing a check valve employed in a further embodiment of the invention.

In FIG. 5 which shows a modification, a discharge valve 57 is caused by its spring force to resiliently contact an inner surface of the arc-shaped spring holder 51 so that the discharge valve 52 is held open. In this modification, since the discharge valve 52 is opened by the effect of its own spring force and the centrifugal force, unnecessary activation of the valve 52 due to a pulsating flow of the refrigerant can be prevented and, therefore noise generally produced by such pulsating flow of the refrigerant can be prevented. Further, since the resistance to the flow of refrigerant at the discharge valve can be reduced, an efficient operation of the scroll compressor can be obtained. Besides, the discharge valve 57 closes the discharge opening 49 due to the pressure of back-flowing refrigerant immediately after the stop of the scroll compressor, so that the refrigerant does not flow back through the discharge opening 49.

Figure 6:
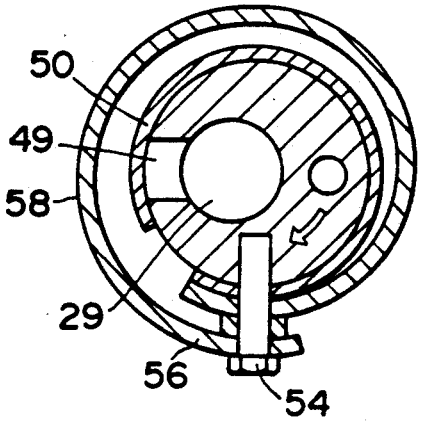
FIG. 6 is a sectional view showing a check valve employed in a still further embodiment of the invention.

FIG. 6 shows another modification in which the circular or arc-shaped valve holder 58 is commonly secured at its opposite ends to the driving shaft together with one end of the arc-shaped valve 50 by the screw 54. This structure provides improvement in the mechanical strength of the assembly.

Figure 7:
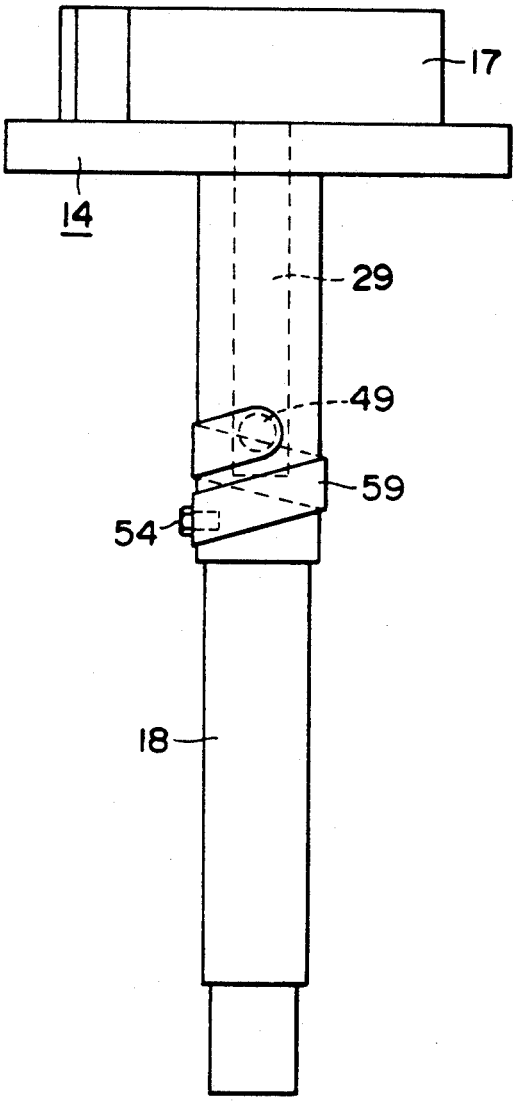
FIG. 7 is a front view showing another embodiment of the invention.

FIG. 7 shows a further modification in which a discharge valve 59 is wound around the driving shaft 18 so that stress generated at the discharge valve 59 can be reduced.

Figure 8:
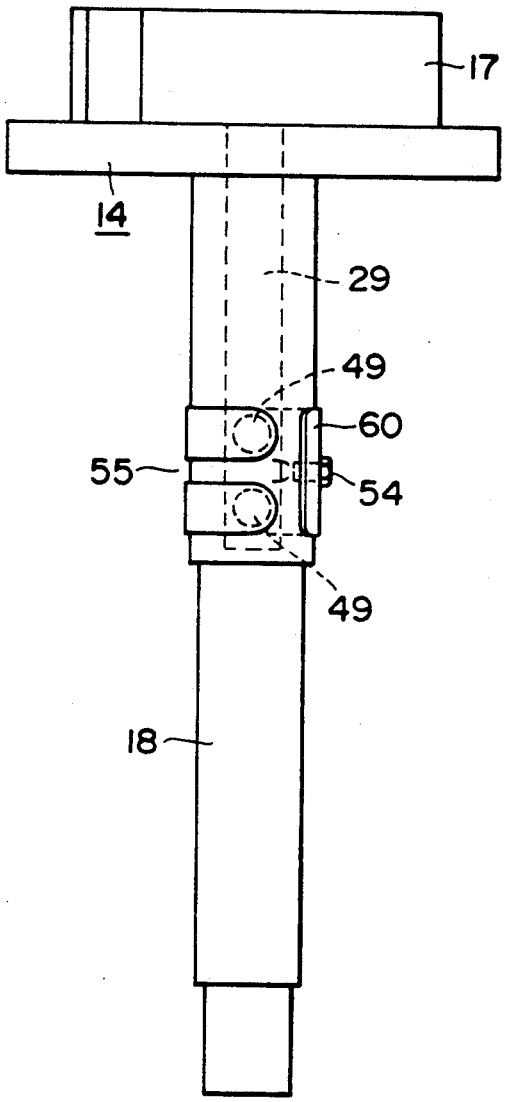
FIG. 8 is a front view showing still another embodiment of the invention.

FIG. 8 shows still another embodiment of the invention in which a discharge valve 60 is divided at its one end into a plurality of portions, such as two portions as in the illustrated embodiment, and similarly the discharge opening 49 is divided into two hole portions. These hole portions (49, 49) are closed by the divided end 55 of the discharge valve 60.

In the embodiments shown in FIGS. 5 to 8, the other structural and operational features can be considered to be similar to those of the embodiment of FIGS. 3 and 4, and a detailed description thereof will be omitted. In each of the embodiments, the discharge port can be provided to the idler or subsidiary shaft 22 instead of the driving shaft 18 and in that case a discharge valve and its holder can be disposed in an appropriate way.

In the embodiment shown in FIGS. 3 and 4 and its modifications shown in FIGS. 5 to 8, the arc-shaped spring valve has a long span to thereby decrease its bending stress, so that it can sufficiently and immediately respond to the refrigerant flow to open and close the discharge opening. During operation of the scroll compressor, the discharge opening can be held open by a centrifugal force and, therefore, unnecessary activation, or open/close movement, of the valve body can be prevented. Thus, noise due to unnecessary activation of the valve body can be limited. Use of the arc-shaped spring valve with the long span may result in a reduction in mechanical strength, but this problem is solved completely by the use of the valve holder. Thus, the improved, noiseless scroll compressor is achieved without back-flow of the refrigerant and without reverse rotation of the scroll members.

What is claimed is:

1. A scroll compressor incorporating an electric motor unit and a scroll compressor unit in a sealed container, wherein said scroll compressor unit comprises:

a first scroll member having an end plate, an involute curve-shaped wrap projecting from one side of said end plate of said first scroll member, and a rotary shaft projecting from the other side of said end plate of said first scroll member and connected to said electric motor unit;

a second scroll member having an end plate, an involute curve-shaped wrap projecting from one side of said end plate of said second scroll member, and a rotary shaft projecting from the other side of said end plate of said second scroll member;

a main frame rotatably supporting said shaft of said first scroll member;

a subsidiary frame rotatably supporting said shaft of said second scroll member;

said wrap of said first scroll member being in juxtaposed engagement relation with said wrap of said second scroll member;

said shaft of said second scroll member being eccentrically spaced from said shaft of said first scroll member so that said wraps of said first and second scroll members are fitted closely together to form a plurality of compression spaces;

a driving device for rotating said second scroll member in the same direction as said first scroll member to continuously compress said compression spaces radially inwardly from an outer portion to an inner position;

wherein one of said shafts of said first and second scroll members has a discharge port connected to said compression spaces, said one of said shafts having a discharge opening for discharging fluid into said sealed container; and wherein a check valve means, having a valve body mounted on said one of said shafts, is provided for closing said discharge opening, said valve body being positioned on said one of said shafts for rotation therewith, whereby said discharge opening is normally maintained open by centrifugal force acting on said valve body.

2. The scroll compressor according to claim 1, wherein said check valve means further includes a spring for holding said valve body, and a valve holder for securing one end of said spring to said one of said shafts.

3. The scroll compressor according to claim 1, wherein said check valve means has an arc-shaped spring discharge valve and an arc-shaped valve holder for holding thereinside said arc-shaped spring discharge valve, said arc-shaped spring discharge valve and said arc-shaped valve holder being fitted together to said one of said shafts.

4. The scroll compressor according to claim 3, wherein said discharge valve and said valve holder are fixed together at one end thereof to said one of said shafts by a common screw, and the other end of each of said discharge valve and said valve holder is located outside said discharge opening.

5. The scroll compressor according to claim 4, wherein one end of each of said discharge valve and said valve holder is located rearwardly of said other end thereof with respect to a rotational direction of said one of said shafts.

6. The scroll compressor according to claim 3, wherein a spring force of said discharge valve causes said discharge valve to be resiliently pressed against an outer surface of said one of said shafts.

7. The scroll compressor according to claim 3, wherein a spring force of said discharge valve causes said discharge valve to be resiliently contacted with an inner surface of said arc-shaped valve holder but which discharge valve closes said discharge opening due to pressure of back-flowing fluid immediately after said one of said shafts stops rotating.

8. The scroll compressor according to claim 3, wherein said discharge valve is wound at least once around said one of said shafts.

9. The scroll compressor according to claim 3, wherein said discharge opening comprises a plurality of discharge opening portions, and said discharge valve is divided at one end thereof into a plurality of end portions to thereby close said discharge opening portions.

* * * * *